US007441357B2

(12) United States Patent
Steer

(10) Patent No.: US 7,441,357 B2
(45) Date of Patent: Oct. 28, 2008

(54) DISPLAY FRAME

(75) Inventor: Gavin Milton Steer, Edenvale (ZA)

(73) Assignee: Product Genesis CC, Modderfontein (ZA)

( * ) Notice: Subject to any disclaimer, the term of this patent is extended or adjusted under 35 U.S.C. 154(b) by 254 days.

(21) Appl. No.: 10/509,896

(22) PCT Filed: Mar. 31, 2003

(86) PCT No.: PCT/IB03/01165

§ 371 (c)(1),
(2), (4) Date: Dec. 30, 2004

(87) PCT Pub. No.: WO03/083813

PCT Pub. Date: Oct. 9, 2003

(65) Prior Publication Data

US 2006/0107571 A1 May 25, 2006

(30) Foreign Application Priority Data

Apr. 2, 2002 (ZA) ..... 20021047

(51) Int. Cl.
*G09F 17/00* (2006.01)

(52) U.S. Cl. ..... 40/603; 40/658; 40/606.12

(58) Field of Classification Search ..... 40/603, 40/606.12, 658, 611.11, 611.12; 38/102
See application file for complete search history.

(56) References Cited

U.S. PATENT DOCUMENTS 1,699,735 A 1/1929 Dabrohua et al.
2,209,972 A * 8/1940 Horwitt ..... 40/739
3,056,572 A * 10/1962 Gelow ..... 248/460
3,169,330 A * 2/1965 Deuchar ..... 40/666
4,265,040 A * 5/1981 Sarkisian ..... 40/618
4,700,498 A * 10/1987 Perutz et al. ..... 40/603
4,717,110 A * 1/1988 Fohrman ..... 248/545
5,365,682 A * 11/1994 Eubank, Jr. deceased ..... 40/746
6,298,591 B1 * 10/2001 Healy ..... 40/600
6,742,294 B1 * 6/2004 Fossum ..... 40/611.1

FOREIGN PATENT DOCUMENTS

DE 29618248 U1 2/1997
DE 29705606 U1 7/1997

* cited by examiner

*Primary Examiner*—Lesley D. Morris
*Assistant Examiner*—Christopher E Veraa
(74) *Attorney, Agent, or Firm*—Jacobson Holman PLLC

(57) ABSTRACT

The invention provides a display frame comprising a backing and a cooperating flexible screen that are securable between a pair of channeled rails provided at the upper and lower edges of the backing. The lower edge of the screen is releasably securable in the channel of the lower rail to enable a poster to be easily inserted and replaced by another poster while the display frame is assembled. The backing is preferably flexibly resilient and curved outwardly from its upper to its lower edge by tensioning means secured between the channeled rails. The channeled rails will preferably include biasing means to secure the backing within the channels of the rails and the flexible screen and/or a poster against the backing. Where the backing is resiliently flexible, the tensioning means will preferably be at least one flexible elongate element which is releasably securable between the channeled rails.

13 Claims, 5 Drawing Sheets

DISPLAY FRAME

This is a nationalization of PCT/IB03/01165 filed Mar. 31, 2003 and published in English.

FIELD OF THE INVENTION

The invention relates to a frame particularly for the display of a poster, print or the like.

BACKGROUND OF THE INVENTION

Posters have numerous applications, one of which is advertising. The presentation of a poster is important and to this end, they are often framed. Framing also protects posters. However, framing is often cumbersome and especially so where posters are required to be changed regularly.

The disclosures of DE 297 05 606 U and DE 296 18 248 U show display frames which can be used for presenting a poster. The first of these documents shows a pair of channeled rails with a close fit to opposite-edges of a screen and backing. At least one rigid elongate connector is provided with oppositely disposed outwardly inclined slots. The slots fit over the rails of the frame respectively. With the rails in the slot, the backing and screen are curved outwardly. DE 295 18 248 U has a rigid and flat backing with inwardly lipped flanges at opposite ends. The screen of this frame is similarly located between the flanges. The frames shown in both of these documents provide an outwardly curved screen behind which a poster is securable.

The meaning of "poster" in this specification includes any sheet of display material.

OBJECT OF THE INVENTION

It is the object of this invention to provide a display frame for posters that allows easy changing of the posters and includes other advantages that will become apparent from this specification.

SUMMARY OF THE INVENTION

In accordance with this invention there is provided a display frame comprising a backing and a cooperating flexible screen, a pair of channeled rails with the upper and lower edges of the backing respectively securable in the channels of the channeled rails and the upper edge of the screen secured at least adjacent to the upper edge of the backing, characterized in that the lower edge of the screen is releasably securable adjacent the backing in the channel of the lower rail with the screen located against the backing.

Further features of the invention provide for the display frame to be configured to engage the upper end of a poster adjacent the upper edge of the screen; for the backing to be curved outwardly from it upper edge to its lower edge; and for the backing to be resiliently flexible and have tensioning means securable between the channeled rails whereby the backing may be flexed against its resillence.

Further features of the invention provide for poster engaging means to be provided adjacent the upper edge of the screen; for the poster engaging means to be is biased against the backing; for the poster engaging means to comprise at least one resillently flexible clip; and for the screen to be located between the backing and at least a portion of the poster engaging clip.

Further features of the invention provide for screen engaging means to bet provided whereby the lower edge of the screen is securable adjacent the backing; and for the screen engaging means to comprise at least one resiliently flexible clip securable on the lower channeled rail.

Further features of the invention provide for retaining means to be provided on the channeled rails whereby the edges of the backing are secured in the channeled rails; for the retaining means to comprise at least one strip of outwardly convex resilient sheet material securable within the channeled rails; for the retaining means to have outwardly extending flanges provided to extend into the channels of the rails and locatable in slots provided in the backing; and for the retaining means in the lower channeled rail to be configured to engage the screen within the channeled rail.

Further features of the invention provide for the tensioning means to comprise at least one flexible elongate element securable between the channeled rails; and for the tensioning means to comprise a pair of flexible elongate elements securable to the channeled rails respectively and securable to each other.

Further features of the invention provide for the channeled rails to be provided with guide channels which are engageable with slides; for the guide channels of the channeled rails to be provided to generally face each other at the rear of the backing whereby the tensioning means is secured to the channeled rails by clips having slides or for the guide channels of the channeled rails to be provided at the outer edges of the channeled rails.

A further feature of the invention provides for the display frame to be securable to another display frame by a clip having a pair of slides.

A further feature of the invention provides for an information display accessory to be securable to the display frame by way of at least one slide provided on the accessory or on a clip securable to the accessory.

A further feature of the invention provides at least one of the channeled rails to have a pair of oppositely disposed ledges provided on its front side to receive a resiliently flexible panel.

These and other features of the invention will become more apparent from the description that follows.

The words "upper" and "lower" are to be understood as meaning operatively upper and lower with respect t the display frame.

BRIEF DESCRIPTION OF THE DRAWINGS

One embodiment of a display frame according to the present invention will be described, by way of example, with reference to the drawings, in which.

DETAILED DESCRIPTION WITH REFERENCE TO THE DRAWINGS

Figure 2:
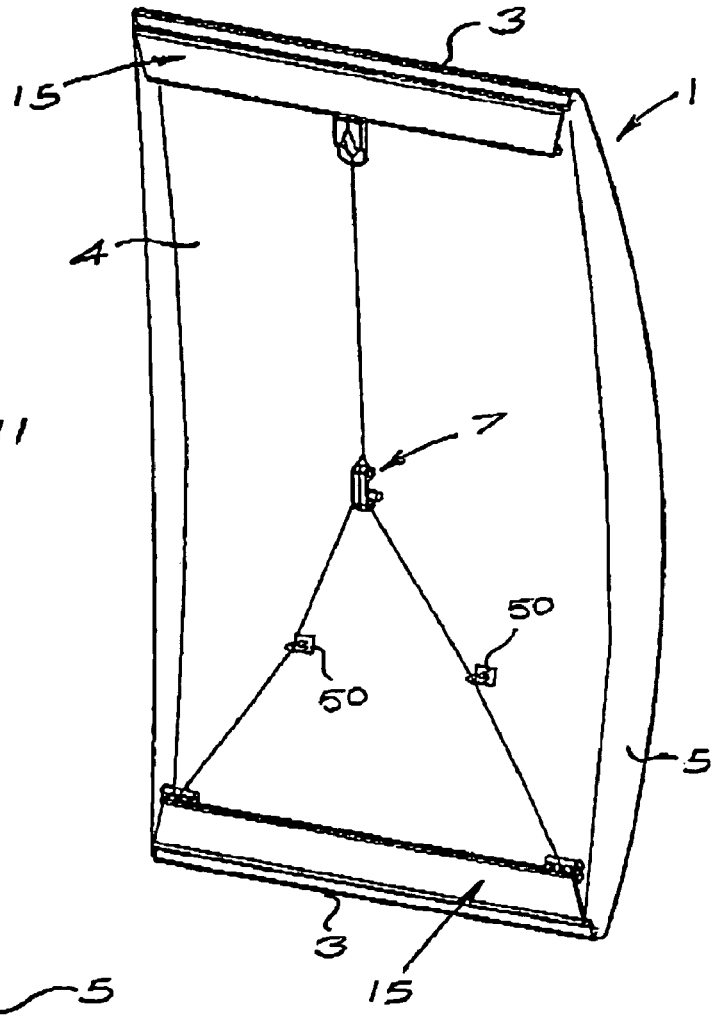
FIG. 2 shows a rear perspective view of the display frame shown in FIG. 1.
Figure 1:
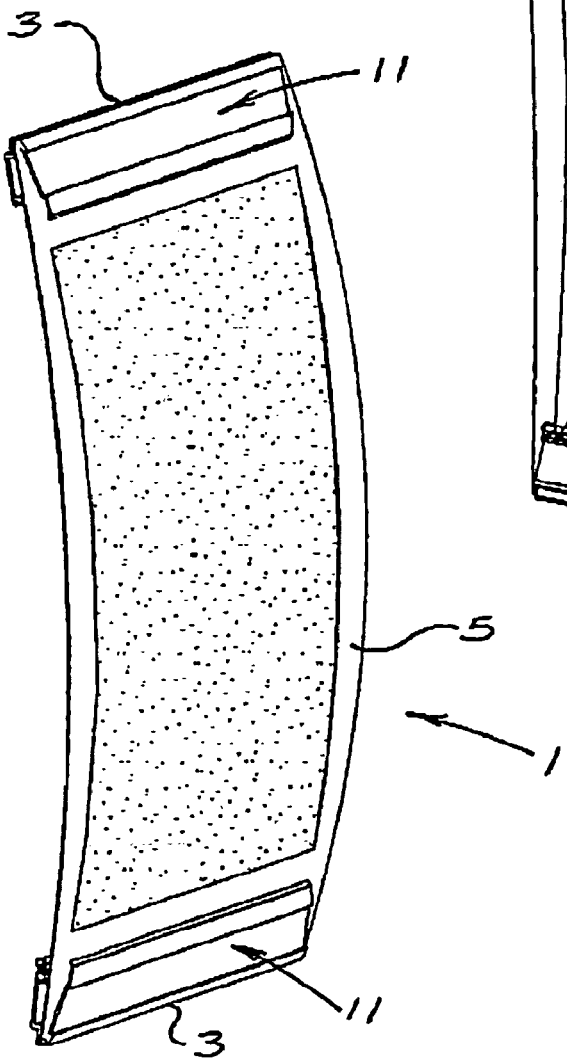
FIG. 1 shows a front perspective view of a display frame.

Referring to FIGS. 1 to 6, a display frame (1) for a poster is shown. The display frame (1) has a pair of oppositely disposed upper and lower channeled rails (3), a resiliently flexible backing (4), a flexible transparent screen (5) and tensioning means (7).

Figure 3:
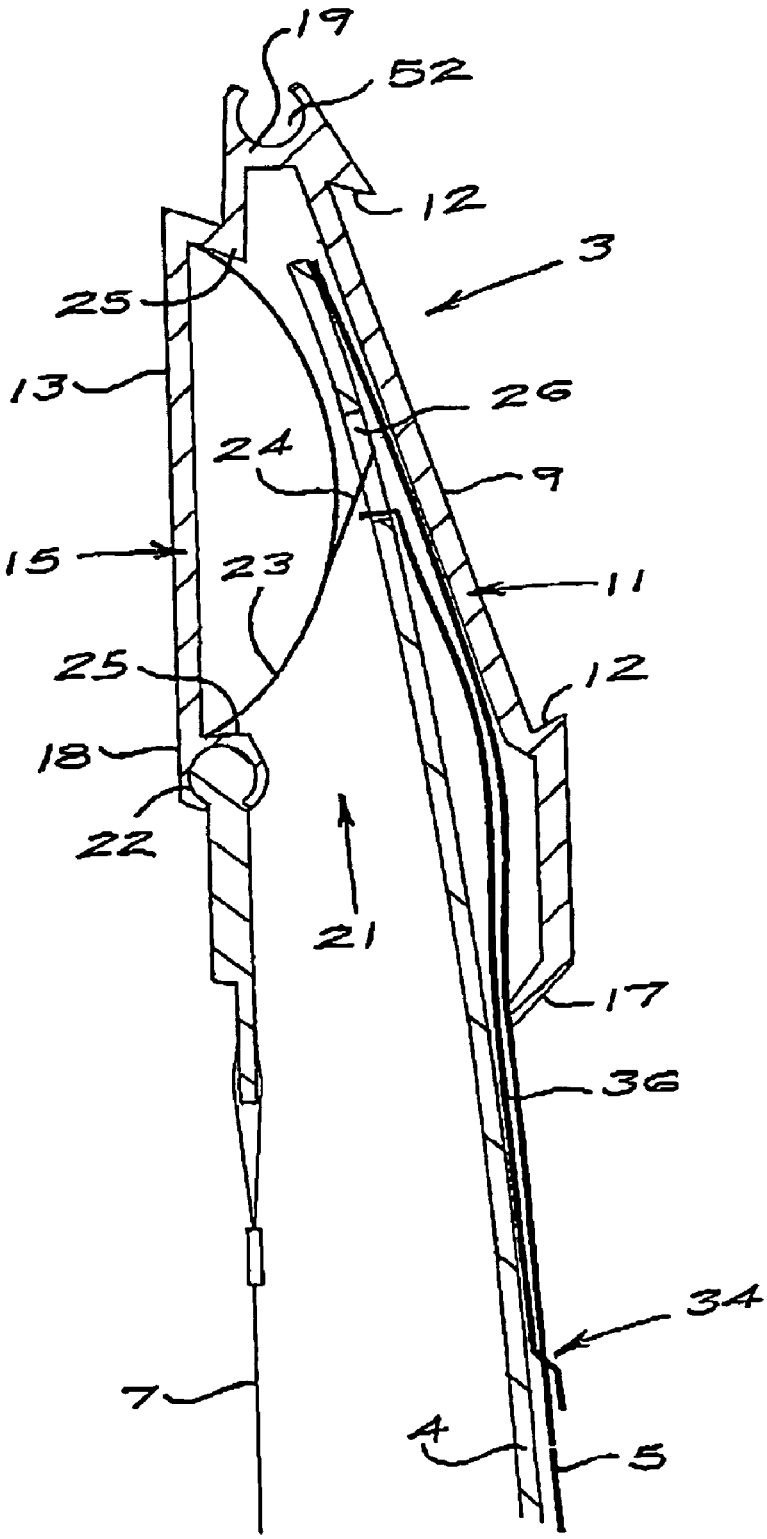
FIG. 3 shows a cross-sectional detail of the upper end of the display frame.
Figure 4:
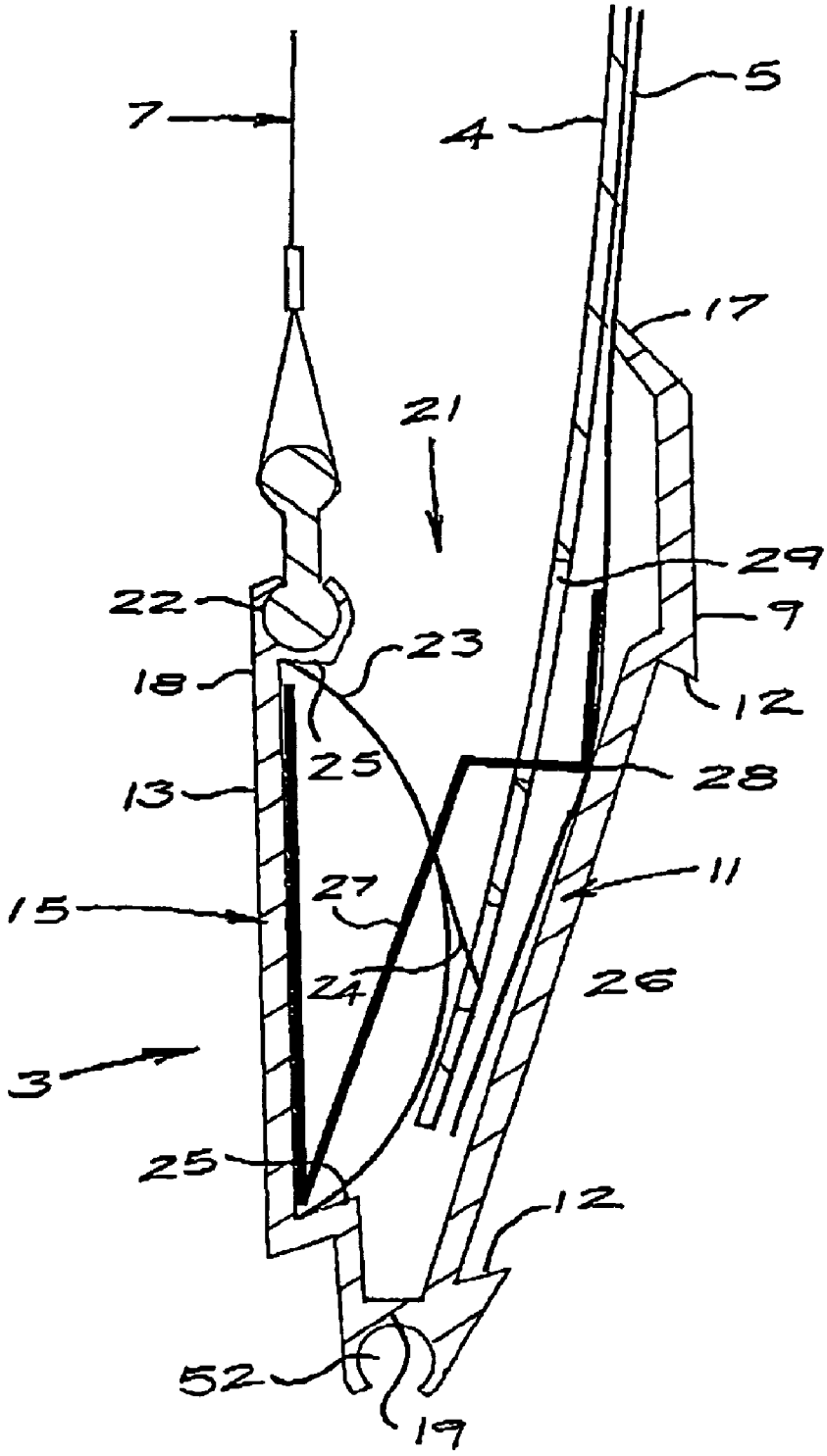
FIG. 4 shows a cross-sectional detail of the lower end of the display frame.

The channeled rails (3), see FIGS. 3 and 4, have a front side (9) provide on a front flange (11) and a rear side (13) provided on a rear flange (15). The front (11) and rear (15) flanges have free edges, (17) and (18) respectively, and are joined by a (18) of the rear flange (15). The front side (9) of the front flange (11) is inwardly stepped to provide a pair of oppositely disposed ledges (12). The ledges (12) are respectively spaced apart from the free edge (17) of the front flange (11) and the web (19).

Figure 5:
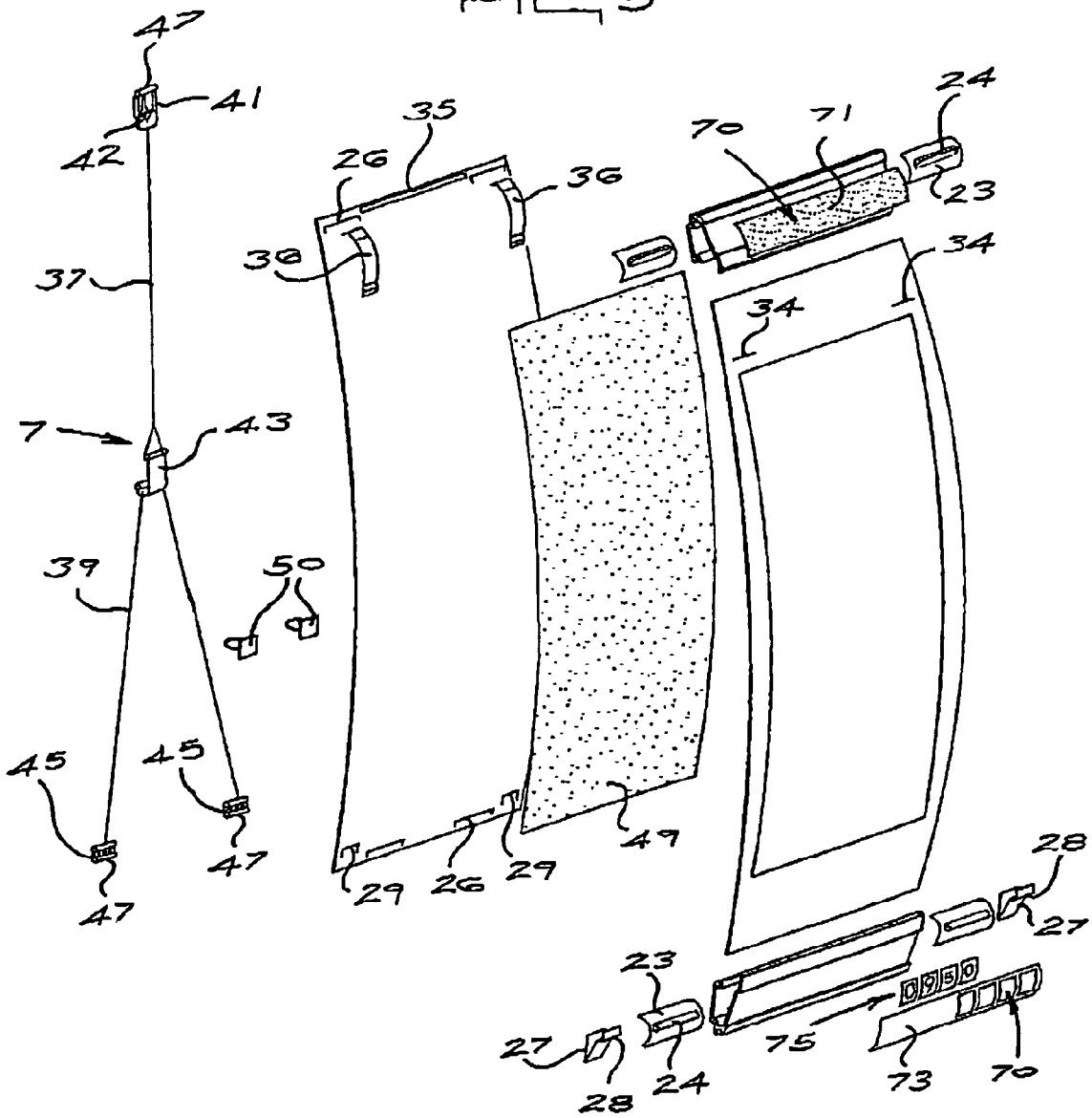
FIG. 5 shows an exploded view of FIG. 1.

Referring to FIGS. 3 and 5, a retaining means (23) is located in the channel (21). The inner side of the rear flange (15) is also provided with a pair of oppositely disposed ledges (25), each spaced apart from the free edge (18) of the flange (15) and the web (19) respectively. The retaining means is a pair of outwardly convex strips (23) of resilient sheet material biased into shape between the ledges (25). Each strip (23) has an outwardly extending flange (24) are formed by cutting a slit spaced apart from and parallel to the longitudinal axes of the strips (23) with transverse slits cut at the ends of the longitudinal slit to extend across the axes. The flanges (24) extend outwardly when the strips (23) are bent about the axes to be biased into shape between the ledges (25). The strips (23) are located in the channels (21) so that the flanges (24) extend towards the webs (19) and engage in slots (26) provided in the backing (4).

The flanges (24) can also be formed by cutting an arched or curved slit in the strips (23) with the centre of the slit on one side of the-longitudinal axes and the ends of the slit extending across the axes.

Screen engaging means (27) are provided to be securable in the channel (21) of the lower channeled rail (3). The screen engaging means consists of a pair of flexibly resilient screen engaging clips (27) made from bent plates of suitable material, such as spring steel. Each screen engaging clip (27) has a based which extends from a first end of the clip (27). The clip (27) is bent at an acute angle at a point spaced apart from the first end to provide the base. The base is sized to be slidable between the ledges (25) but secured against withdrawal past the ledges (25). The clip (27) is cranked at a point spaced apart from the free end of the clip (27). The portion of the clip (27) between the crank and the free end is inclined towards the base to provide a screen (5) engaging shoulder (28) which biases the screen (5) against the rear side of the front flange (11). The backing (4) is provided with a pair of openings (29) on either side of slots (26) through which the clips (27) extend to engage the screen (5) against the flange (11). Openings (not shown) may also be provided in the screen (5) for the shoulders (28) of the clips (27) to extend through and engage the inner side of the front flange (11).

The screen (5) and backing (4) are substantially coextensive with parallel upper and lower edges. The screen (5) and the backing (4) are secured to each other adjacent to their upper ends by a strip of double sided adhesive tape (35). This can also be done using plastic rivets or any other suitable means and can also be at a point spaced apart from me upper edge.

Poster engaging means (36) are provided in the form of a pair of resiliently flexible poster engaging clips (36). The poster engaging clips (36) are bent at one end. This end operatively locates in the slots (26) for the flanges (24) of the retaining strips (23) adjacent the upper edge of the backing (4), respectively. This arrangement secures the clips (36) in relation to the backing (4). The other ends of the poster engaging clips (36) are stepped to extend through slots (34) provided in the screen (5). The poster engaging clips (36) are curved to be flexed between the backing (4) and the screen (9) against the inner surface and free edge (17) of the front flange (11). The stepped ends of the poster engaging clips (36) bias the poster against the backing (4). The screen (5) is thus located between the portion of the clips (36) between the step and the free end and the backing (4). It will be appreciated that the poster will be released by the clips (36) when the screen (5) is lifted away from the backing (4) to a sufficient degree. The poster engaging clips (36) are made from strips of spring steel, however they may also be made from any other suitable material. Where they are made from plastics material, for example, the clips (36) can be conveniently moulded to shape.

The clips (36) may also have their own locating slots (not shown) to which they have a tight fit instead of using the slots (26) for the flanges (24). The portion of the clips (36) that engage the poster (49) will favourably be provided with some gripping formation to facilitate frictional engagement. An outwardly extending formation to apply pressure onto the poster (49) is one example. Such a formation could simply be press formed into that portion of the clip (35).

The tensioning means (7), see FIG. 5, is made up of a first (37) and a second (39) flexible elongate element. The first element (37) is secured at one end to a clip (41) and at the other end to a hook (43). The clip (41) has an aperture (42). The second element (39) has each end secured to one of a pair of clips (45). The clips (41) and (45) are provided with slides (47) at their free ends. The slides (47) have an axially sliding and transversely looking fit into the guide channels (22) of the rear flanges (15). Enlargements (not shown) provided at the outer ends of the slides (47) locate the clips (45) at the outer ends of the rear flange (15). The slide (47) of the dip (41) however has no such enlargement and can, slide to a central position on the rear flange (15). The first element (37) and the second element (39) are respectively secured to the rear flanges (15) of the upper and the lower channeled rails (3) as described above. The elements (37) and (39) are of such a length that they can only be connected to each other with the backing (4) of an assembled display frame (1) flexed to curve outwardly.

The backing (4) is made from sheets of extruded plastics material. In this embodiment of the invention, the sheet material is extruded to have parallel air cores with each core sharing a common wall with an adjacent core. The material is cut so that the cores extend from the upper edge to the lower edge of the backing (4). The screen (5) is made from thin sheets of extruded plastics material. The channeled rails (3) are made from lengths of aluminium extruded in the required form. They could also be made from other materials, such as suitably hard plastics. The elongate elements (37) and (39) can be made from plastics material wire or string. Any other suitable material may also be used.

The front side of the backing (4) may be provided with at least one support flange (not shown). This can conveniently be made of a strip of sheet material that is secured to the backing (4) spaced apart from the lower edge. An upper portion of the strip is free from the backing (4) and the lower edge of a poster (49) can be tucked behind this portion. It will be appreciated that this will locate the poster in the frame and prevent its lower edge from sliding past the flange.

The display frame (1) is assembled by holding the retaining strips (23), screen engaging clips (27) and poster engaging clips (36) in position relative to the slots (26) and (29) of the backing (4) and the slots (34) in the screen (5). The channeled rails (3) are then slid over the upper and lower edges of the backing (4) and screen (5) securing the retaining means (23), screen engaging means (27) and poster engaging means (36) in position.

The lower edge of the screen (5) can then be parted from that of the backing (4). This, is done by sliding the screen (5) out of engagement with the shoulders (28) of the screen engaging clips (27) and lifting the screen (5) from the backing (4). A poster (49) is placed between them. Once the portion of the screen (5) with the slots (34) through which the stepped ends of the poster engaging clips (36) extend is lowered over the poster (49) a friction fit is exerted on the poser (49), securing it in position.

The two channeled rails (3) are then moved towards each other to flex the backing (4) against its resilience. This causes the backing (4) to be curved outwardly. The elements (37) and (39) are then connected to each other by placing the second element (39) through the hook (43) of the first element (37). The resilience of the bent backing (4) tensions the elements (37) and (39) which in turn resist the resilience. This pulls the channeled rails (3) onto the respective edges of the backing (4) holding the assembled components of the display frame (1) together in a bow configuration.

The display frame (1) can then be suspended in any convenient manner, one of which would be to hang it on a nail using the aperture (42) provided in the clip (41).

Where a large display frame (1) is to be used, a pair of eyes (50) are secured to the lower region of the backing (4). The second element (39) is threaded through the eyes (50) as shown in FIG. 2 to prevent sagging of the backing (4) and maintain a more desirable generally uniform curved shape.

The pair of opposed ledges (12) on the front side (9) of the front flange (11) are suited to receive resiliently flexible panels (70) in the form of information cards (71) and screens for displaying prices (73). The Information cards (71) consist of a strip of resilient material with desired information or graphics depicted thereon. The card (71) is secured between the ledges (12) under the bias of its resilience. The screens for displaying prices (73) are made of a resilient transparent strip of plastics material that is similarly secured between the ledges (12) but with price cards (75) secured and on display under the screens (73).

It is also possible to change a poster (49) without dissembling the frame (1) or even removing it from a position where it is hanging. This is done by sliding the lower end of the screen (5) out of the lower channeled rail (3) while the backing (4) is retained in position. The screen (5) is then lifted to allow access to the poster (49) that is to be removed. A new poster (49) is positioned on the backing (4) with the upper end of the poster (49) positioned between the backing (4) and the poster engaging dips (36) which, once the portion of thee screen (5) with the slots (34) is back in position, prevent the poster (49) from sliding down. This allows a person to use both hands to tuck the lower edge of the screen (5) back into the lower channeled rail (3) to be engaged by the shoulders (28) of the screen engaging clips (27).

It will be appreciated that the retaining means (23) can be provided to bias the backing (4) and the screen (5) against the rear side of Fe front flange (11). The retaining strips (23) need not have flanges (24) and the backing (4) may be provided without slots (26). In this embodiment the retaining means (23) will also function as a screen engaging means (27) by biasing the backing (4) to frictionally engage the screen (5) against rear side of the front flange (11). In another embodiment where the retaining strips (23) do have flanges (24) and the backing (4) does have slots (26), the flanges (24) may be provided to frictionally engage the screen (5) against rear side of the front flange (11) of the rail (3).

As another form of poster engaging means (36), the backing (4) may provided with a friction affording portion which faces the screen (5) spaced apart on the backing (4) from its upper edge. This friction affording portion may conveniently be a strip of sand paper which engages the poster (49) when the screen (5) lies against the outwardly curved backing (4).

Figure 6:
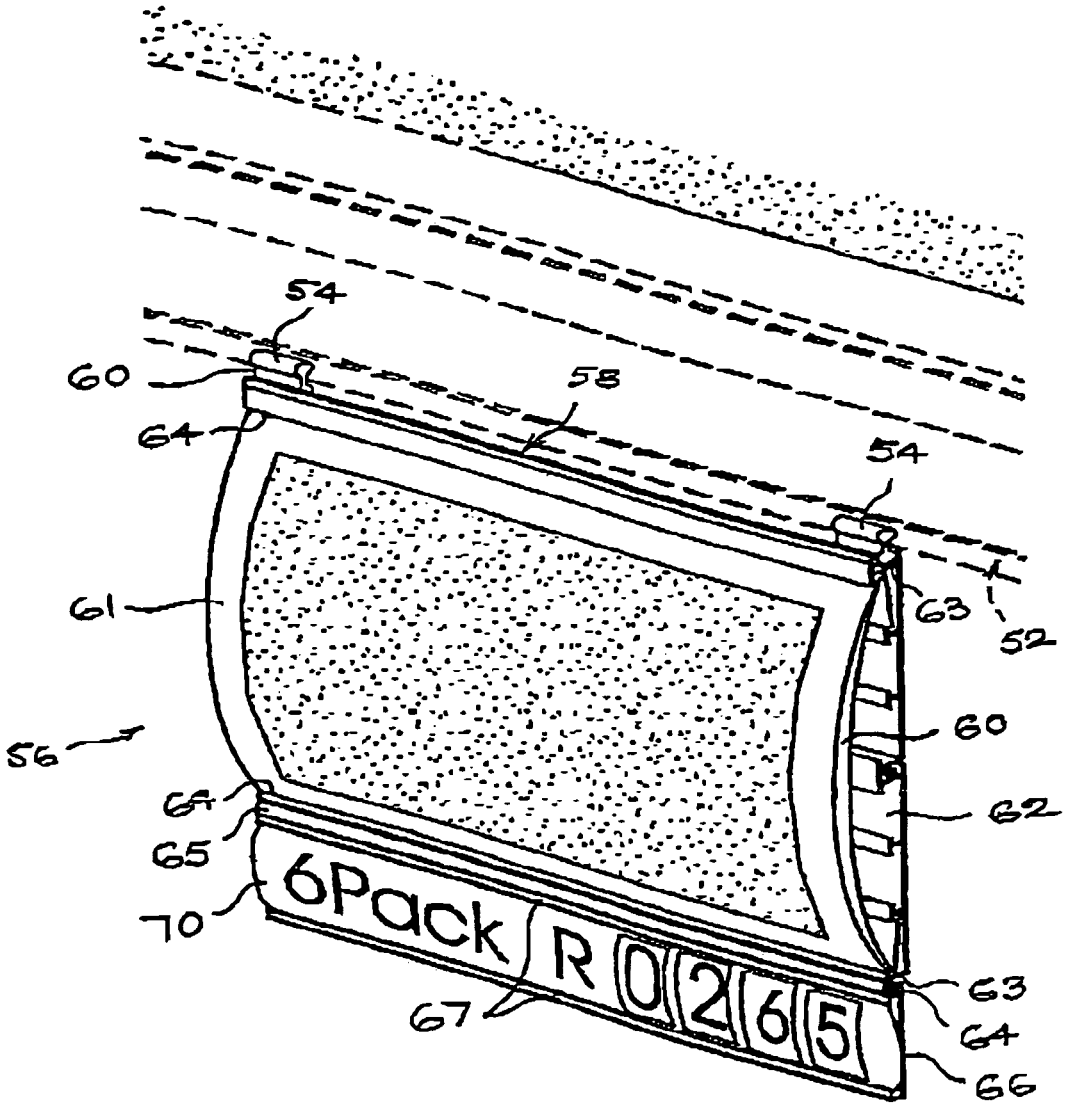
FIG. 6 shows an information display accessory secured to the lower channeled rail of a display frame.

Extending along the web (19) of each channeled rail (3) is a lipped guide channel (52). Referring to FIG. 6, the channel (52) co-operates with a slide (54), such as the ones (47) of clips (45). In this way a display accessory (56) to the display frame (1) having a guide channel (58) at it upper edged can be suspended below the frame (1) using clips (60) provided with a pair of outwardly oppositely facing slides (54).

The display accessory (56) is shown having a screen (61) and a support (62). The support (62) is rigid and has an upper and a lower edge. A pair of opposed outer flanges (63) extend forwardly, one from each of the edges of the support (62). Inwardly extending lips (64) are provided at the edges of the flanges (63). The screen (61) is resiliently flexible and forwardly convex. Its upper and lower edges are parallel. The distance between the upper and lower edges of the screen (61) is slightly greater than the distance between the flanges (63) of the support (62). The screen (61) is thus sized to have a clip fit to the support (62), under the bias of its resilience against the opposed outer flanges (63). Any suitably sized information card (60) depicting desired information and/or images can be located behind the screen (61) for display.

In this embodiment, the display accessory (56) is also used to indicate the prices of articles. A slide (64) provided along the lower edge of the support (62) cooperates with a guide channel (65) at the upper edge of a second support (66). The second support (66) also provides a pair of opposed lipped flanges (67) which are suited to receive resiliently flexible panels (70) as described with reference to FIG. 5.

It will be appreciated that the display accessory (56) may take any of a number of different forms. The display accessory (56) allows for additional information to be displayed along with the poster (49) in the display frame (1).

It will be also appreciated that the sequence of guide channels and slides as provided on interconnectable components described above can be varied. In other words, the slides can be provided on the channeled rails (3) with the guide channels on the clips or other accessories. The guide channels are however preferably made from material that is sufficiently rigid to prevent the guide channels from opening.

Furthermore, the channel (52) provided at the upper edge of the upper channeled rail (3) can be used with the clips (41) and (45), which have sliding rails (47), to provide alternate ways of suspending the display frame (1).

The display frame (1) may also have a rigid backing (4). This can be curved or planar. One advantage, however, with the resiliently flexible backing (4) as described above is that tensioning means (7) of an assembled display frame (1) can be disengaged to allow for storage or transport with the backing (4) flat. For this purpose, a spacer can be secured between the first (37) and second (39) elongate members of the tensioning means (7) to hold them in position relative to each other and taut but without bending the backing (4). The spacer can be a length of cord that extends from the hook (43) of the first element (37) and has a similar hook secured at its free end for engaging the second element (39) are simply an elastic band securable between the two elements (37, 39).

It will also be appreciated that a single component ran be provided to serve as both retaining means (23) and screen engaging means (27) and that this component may also secure the upper edge of the screen (5) adjacent that of the backing (4).

A person skilled in the art will appreciate that there are a number of variations that may be made to the described embodiments to provide alternative embodiments that will fall within the scope of the present invention.

The invention claimed is:

1. A display frame comprising a backing with a front side against which a poster is securable, a pair of channeled rails with upper and lower edges of the backing securable in respective channels of the channeled rails, the backing being resiliently flexible with tensioning means securable between the channeled rails on a rear side of the backing, the tensioning means including at least one elongate flexible element, the backing being flexible outwardly against its resilience, and biasing means provided on the channeled rails so that the backing is securable in the channels and a flexible screen and/or poster are securable against the backing.

2. The display frame as claimed in claim 1, wherein the biasing means includes retaining means to secure the backing in the channels and screen engaging means to secure the screen and/or poster in the channels against the backing.

3. The display frame as claimed in claim 2, wherein the retaining means and/or screen engaging means are provided by a resiliently flexible clip located within the channels of the channeled rails.

4. The display frame as claimed in claim 2, wherein the retaining means and/or screen engaging means are provided by at least one strip of outwardly convex resilient sheet material located within the channels of the channeled rails.

5. A display frame comprising a backing and a flexible screen securable against the backing, and a pair of channeled rails with the upper and lower edges of the backing respectively securable in the channels of the channeled rails, the backing being resiliently flexible with tensioning means securable between the channeled rails on a rear side of the backing, the backing being flexible outwardly against its resilience, the tensioning means including at least one elongate flexible element.

6. The display frame as claimed in claim 5, wherein the elongate flexible element is releasably securable between the channeled rails.

7. The display frame as claimed in claim 6, wherein a pair of elongate elements are securable between the channeled rails respectively and releasably securable to each other.

8. A display frame comprising a backing having upper and lower edges, a cooperating flexible screen, upper and lower channeled rails with the upper and lower edges of the backing being received in respective channels of the channeled rails, the backing being resiliently flexible with tensioning means releasably securable between the upper and lower channeled rails to hold the backing curved outwardly against its resilience, the tensioning means including at least one elongate flexible element, and biasing means within the channel of the lower channeled rail to releasably secure the screen against the backing.

9. The display frame as claimed in claim 8, wherein a poster engaging means is provided adjacent the upper edge of the screen.

10. The display frame as claimed in claim 9, wherein the poster engaging means includes at least one resiliently flexible poster engaging clip.

11. The display frame as claimed in claim 10, wherein a portion of the screen is located between the backing and at least part of the poster engaging clip.

12. A display frame comprising a backing having upper and lower edges, a cooperating flexible screen, upper and lower channeled rails with the upper and lower edges of the backing being received in respective channels of the channeled rails, the backing being resiliently flexible with tensioning means releasably securable between the upper and lower channeled rails to hold the backing curved outwardly against its resilience, and biasing means within the channel of the lower channeled rail to releasably secure the screen against the backing, the biasing means including at least one resiliently flexible clip.

13. A display frame comprising a backing having upper and lower edges, a cooperating flexible screen, upper and lower channeled rails with the upper and lower edges of the backing being received in respective channels of the channeled rails, the backing being resiliently flexible with tensioning means releasably securable between the upper and lower channeled rails to hold the backing curved outwardly against its resilience, and biasing means within the channel of the lower channeled rail to releasably secure the screen against the backing, the biasing means being provided by at least one strip of outwardly convex resilient sheet material.

* * * * *